US012246223B2

(12) United States Patent
Jennings

(10) Patent No.: US 12,246,223 B2
(45) Date of Patent: Mar. 11, 2025

(54) WEARABLE CLIMBING DEVICE

(71) Applicant: Raymond Jennings, Midland, MI (US)

(72) Inventor: Raymond Jennings, Midland, MI (US)

( * ) Notice: Subject to any disclaimer, the term of this patent is extended or adjusted under 35 U.S.C. 154(b) by 682 days.

(21) Appl. No.: 17/503,991

(22) Filed: Oct. 18, 2021

(65) Prior Publication Data

US 2023/0121159 A1 Apr. 20, 2023

(51) Int. Cl.
*A63B 27/02* (2006.01)

(52) U.S. Cl.
CPC ..... *A63B 27/02* (2013.01)

(58) Field of Classification Search
CPC ..... A63B 27/02
See application file for complete search history.

(56) References Cited

FOREIGN PATENT DOCUMENTS

WO WO-2019092321 A1 * 5/2019 ..... A63B 1/00

* cited by examiner

*Primary Examiner* — Rick K Chang
(74) *Attorney, Agent, or Firm* — The Iwashko Law Firm, PLLC; Lev Ivan Gabriel Iwashko

(57) ABSTRACT

A wearable climbing device, including a main body, including a bottom section to receive a foot of a user thereon, a top section removably connected to at least a portion of the bottom section, and a spike disposed on at least a portion of the bottom section to penetrate into at least one of a tree and a utility pole, a calf strap removably connected to at least a portion of the main body to be worn around a calf of the user, and an ankle strap removably connected to at least a portion of the main body to be worn around an ankle of the user.

6 Claims, 2 Drawing Sheets

WEARABLE CLIMBING DEVICE

BACKGROUND

1. Field

The present general inventive concept relates generally to climbing, and particularly, to a wearable climbing device.

2. Description of the Related Art

Climbing a tree and/or a utility pole can be a dangerous task. Regardless of the type of person performing the task, it remains difficult even for those doing it as a condition for commercial labor. Specifically, there is a substantial risk that a climber will fall and sustain severe injury while climbing the tree and/or the utility pole. Several factors contribute to the danger such as improper gear, improperly securing the gear, and/or mistakes during climbing.

Moreover, current equipment available in the market is known to cause pain and discomfort as these tools tend to employ single bar spurs. In other words, a majority of weight on the spur while climbing is favored by one side due to the single bar. In other words, the weight distribution on the spur is highly uneven.

Therefore, there is a need for a wearable climbing device that provides high stability for a user during climbing.

SUMMARY

The present general inventive concept provides a wearable climbing device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a wearable climbing device, including a main body, including a bottom section to receive a foot of a user thereon, a top section removably connected to at least a portion of the bottom section, and a spike disposed on at least a portion of the bottom section to penetrate into at least one of a tree and a utility pole, a calf strap removably connected to at least a portion of the main body to be worn around a calf of the user, and an ankle strap removably connected to at least a portion of the main body to be worn around an ankle of the user.

The bottom section may include a bottom first arm, and a bottom second arm disposed in parallel to the bottom first arm.

The main body may further include a stirrup disposed between the bottom first arm and the bottom second arm to receive at least a portion of the foot of the user thereon.

The top section may include a top first arm, and a top second arm disposed in parallel to the top first arm.

The spike may be bent in an angular direction away from the bottom section.

The main body may be adjustable in height by moving the top section toward or away from the bottom section.

The calf strap may include a plurality of layers.

The wearable climbing device may further include a plurality of bracing bands disposed on at least a portion of the main body to receive at least a portion of the calf strap therein and prevent the calf strap from lateral movement within each of the plurality of bracing bands.

The plurality of bracing bands may be removably connected to at least a portion of the top section.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
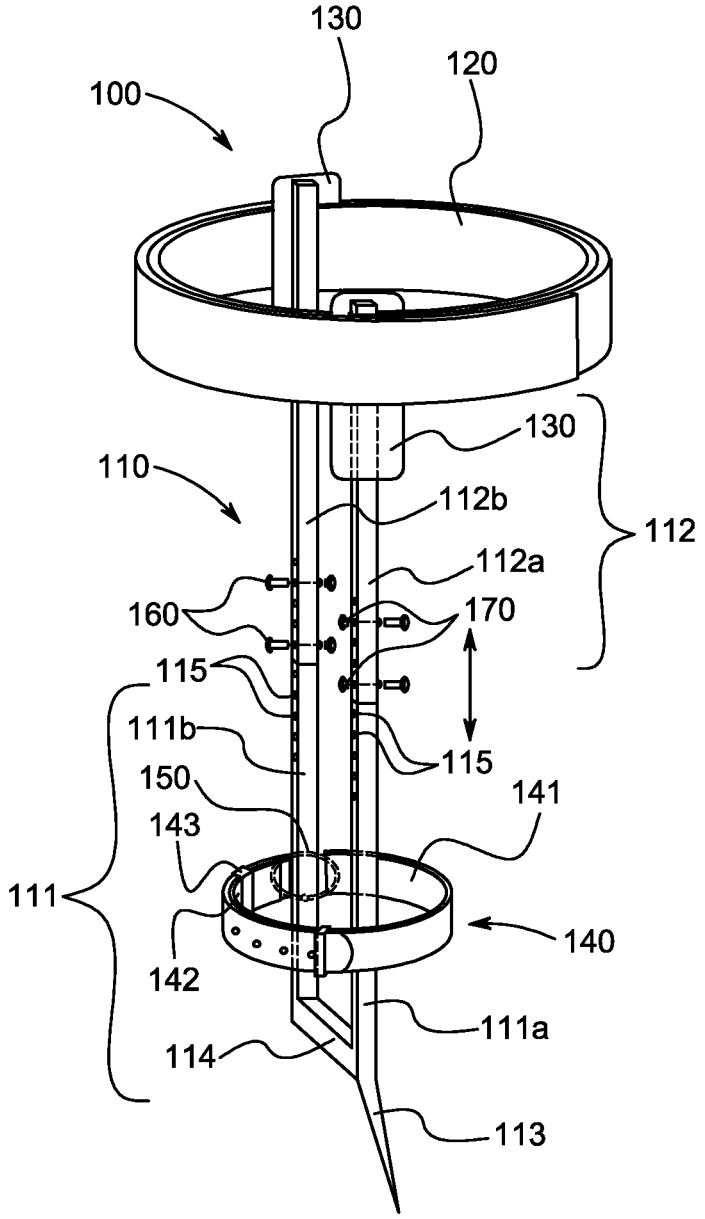
FIG. 1 illustrates a side perspective view of a wearable climbing device, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Wearable Climbing Device 100
Main Body 110
Bottom Section 111
Bottom First Arm 111*a*
Bottom Second Arm 111*b*
Top Section 112
Top First Arm 112*a*
Top Second Arm 112*b*
Spike 113
Stirrup 114
Fastener Receiving Apertures 115
Calf Strap 120
Bracing Bands 130
Ankle Strap 140
Strap Body 141
Buckle 142
Strap Holder 143
Connecting Ring 150
Rod Fasteners 160
Fastener Receiving Connectors 170

FIG. 1 illustrates a side perspective view of a wearable climbing device 100, according to an exemplary embodiment of the present general inventive concept.

Figure 2:
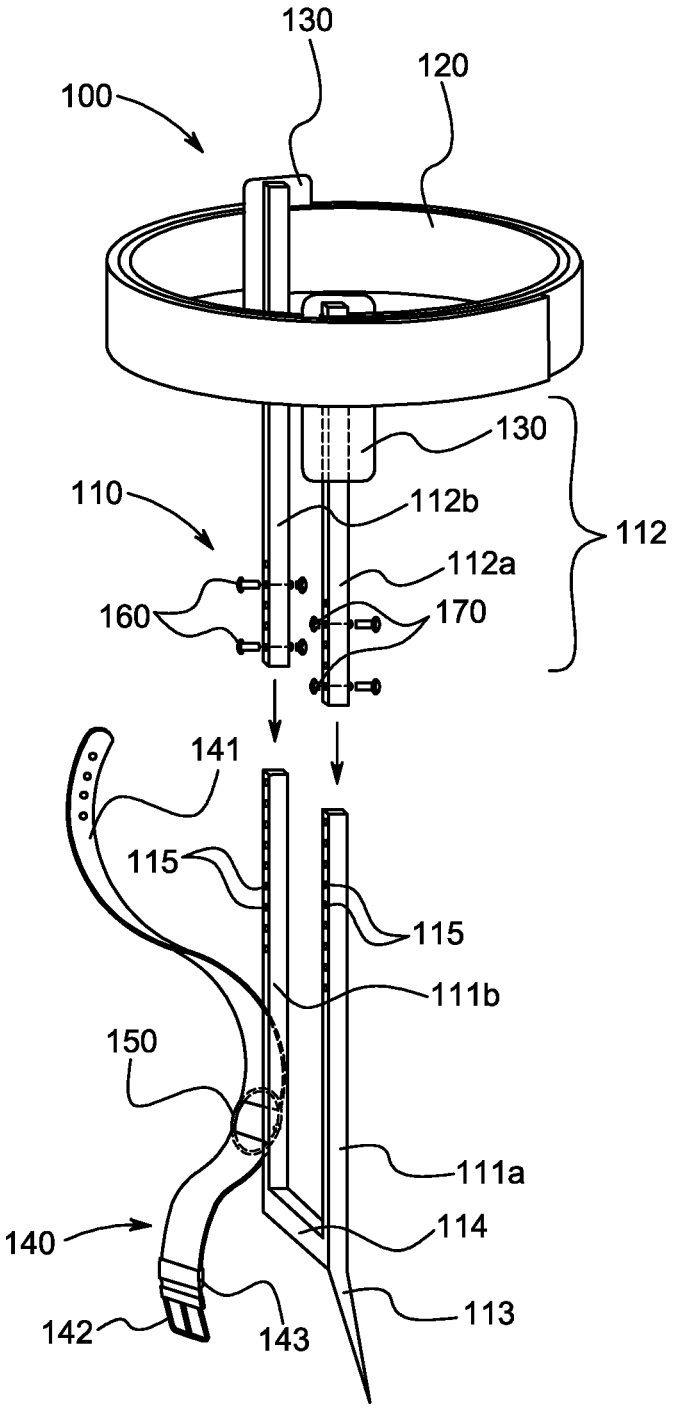
FIG. 2 illustrates a side perspective view of the wearable climbing device with a first section separated from a second section, according to an exemplary embodiment of the present general inventive concept.

FIG. 2 illustrates a side perspective view of the wearable climbing device 100 with a first section 111 separated from a second section 112, according to an exemplary embodiment of the present general inventive concept.

The wearable climbing device 100 may be constructed from at least one of metal, plastic, cloth, wood, and rubber, etc., but is not limited thereto.

The wearable climbing device 100 may include a main body 110, a calf strap 120, a plurality of bracing bands 130, an ankle strap 140, a connecting ring 150, a plurality of rod fasteners 160, and a fastener receiving connectors 170, but is not limited thereto.

Referring to FIGS. 1 and 2, the main body 110 is illustrated as a plurality of rods (e.g., two rods). However, the main body 110 may be a single rod and/or more than two rods (e.g., three, four, five, six, etc.).

The main body 110 may include a bottom section 111, a top section 112, a spike 113, a stirrup 114, and a plurality of fastener receiving apertures 115, but is not limited thereto.

The bottom section 111 may include a bottom first arm 111*a* and a bottom second arm 111*b*, but is not limited thereto.

The bottom first arm 111*a* may be disposed in parallel to the bottom second arm 111*b*. Moreover, the bottom second arm 111*b* may be distanced away from the bottom first arm 111*a*. Also, the bottom first arm 111*a* may have a size and/or a shape equivalent to a size and/or a shape of the bottom second arm 111*b*.

The top section 112 may include a top first arm 112*a* and a top second arm 112*b*, but is not limited thereto.

The top first arm 112*a* may be disposed in parallel to the top second arm 112*b*. Moreover, the top second arm 112*b* may be distanced away from the top first arm 112*a*. Also, the top first arm 112*a* may have a size and/or a shape equivalent to a size and/or a shape of the top second arm 112*b*.

Furthermore, the top section 112 may be removably connected at a first end to at least a portion of a first end of the bottom section 111. More specifically, the top first arm 112*a* and/or the top second arm 112*b* may be removably connected to at least a portion of the bottom first arm 111*a* and/or the bottom second arm 111*b*, respectively. Collectively, the bottom first arm 111*a* and/or the top first arm 112*a* may be considered a first arm of the main body 110, and the bottom second arm 111*b* and/or the top second arm 112*b* may be considered a second arm of the main body 110.

The spike 113 may be disposed on at least a portion of a second end of the bottom section 111 opposite with respect to the first end. Additionally, referring again to FIGS. 1 and 2, the spike 113 is illustrated to extend away from the bottom first arm 111*a*. However, the spike 113 may extend away from the bottom second arm 111*b*. The spike 113 may taper from the second end of the bottom section 111 to a point at a distance away from the bottom section 111. Accordingly, the spike 113 may be inserted and/or penetrate into a portion of a tree and/or a utility pole. The spike 113 may support the main body 110 thereon, while inserted within the tree and/or the utility pole. Furthermore, the spike 113 may be bent in an angular direction away from the bottom section 111. It is important to note that the spike 113 may be bent away from the bottom section 111 because it would be difficult to insert the spike 113 into the tree and/or the utility pole from under the bottom section 111.

The stirrup 114 may be disposed between the bottom first arm 111*a* and/or the bottom second arm 111*b*. In other words, the stirrup 114 may connect the bottom first arm 111*a* to the bottom second arm 111*b*. Furthermore, the stirrup 114 may receive at least a portion of a foot of a user thereon, such that the user may stand on the stirrup 114.

The plurality of fastener receiving apertures 115 may be disposed on at least a portion of the bottom first arm 111*a*, the bottom second arm 111*b*, the top first arm 112*a*, and/or the top second arm 112*b*. The plurality of fastener receiving apertures 115 may receive at least one fastener therein.

The calf strap 120 may include a plurality of layers and a fastener (e.g., a hook and loop fastener), but is not limited thereto.

The calf strap 120 may be removably connected to at least a portion of the main body 110. More specifically, the calf strap 120 may wrapped in a loop around at least a portion of a second end of the top section 112, such that the calf strap 120 may wrap around the top first arm 112*a* and/or the top second arm 112*b*. The calf strap 120 may be disposed (i.e., worn) around a calf of the user to secure the calf of the user against the top first arm 112*a* and/or the top second arm 112*b*. The calf strap 120 may be adjusted with respect to size (i.e., diameter, circumference) to fit around the calf of the user.

The calf strap 120 may have a first layer (i.e., an inner layer) constructed of synthetic fabric and is highly resistant to wear and tear. The calf strap 120 may have a second layer (i.e., a middle layer) constructed of foam to absorb an impact from an external object, such as the tree and/or the utility pole. The calf strap 120 may have a third layer (i.e., an outer layer) constructed of foam, different from the second layer, to absorb the impact from the external object, as well as, reduce a temperature level within the calf strap 120.

The plurality of bracing bands 130 may be disposed on at least a portion of the main body 110 and removably connected to at least a portion of the calf strap 120. More specifically, each of the plurality of bracing bands 130 may receive at least a portion of the calf strap 120 therein. Each of the plurality of bracing bands 130 may be removably connected to at least a portion of the second end of the top first arm 112*a* and/or the top second arm 112*b*. The plurality of bracing bands 130 may prevent the calf strap 120 from lateral movement within each of the plurality of bracing bands 130 absent an application of force (e.g., pushing, pulling) from the user, such that the calf strap 120 remains in a fixed position while worn around the calf of the user.

The ankle strap 140 may include a strap body 141, a buckle 142, and a strap holder 143, but is not limited thereto.

The strap body 141 may be connected to at least a portion of the bottom section 111. Referring again to FIGS. 1 and 2, the strap body 141 is illustrated to be connected to the bottom second arm 111*b*. However, the strap body 141 may be removably connected to at least a portion of the bottom first arm 111*a*. The strap body 141 may be disposed (i.e., worn) around an ankle of the user to secure the ankle of the user against the bottom first arm 111*a* and/or the bottom second arm 111*b*. The strap body 141 may be adjusted with respect to size (i.e., diameter, circumference) to fit around the ankle of the user.

The buckle 142 may be disposed on at least a portion of a first end of the strap body 141. The buckle 142 may receive a second end of the strap body 141 to fasten at least a portion of the second end of the strap body 141 therein. In other words, the second end of the strap body 141 may be inserted through the buckle 142 to fasten the second end of the strap body 141 into the buckle 142.

The strap holder 143 may be movably (i.e., slidably) connected to at least a portion of the strap body 141. The strap holder 143 may move toward the first end of the strap body 141 in a first direction, and toward the second end of the main body 141 in a second direction. The strap holder 143 may cover at least a portion of the second end of the strap body 141, while the second end of the strap body 141 is inserted into the buckle 142. As such, the strap holder 143 may prevent the second end of the strap body 141 from moving away from a center portion of the strap body 141.

The connecting ring 150 may be connected to at least a portion of the bottom section 111. Referring again to FIGS. 1 and 2, the connecting ring 150 is illustrated to be connected to the bottom second arm 111*b*. However, the connecting ring 150 may be connected to at least a portion of the bottom first arm 111*a*.

The connecting ring 150 may connect the ankle strap 140 to the bottom section 111.

Each of the plurality of rod fasteners 160 may include a screw, a nail, a bolt, a magnet, and/or any combination thereof, but is not limited thereto.

Each of the plurality of rod fasteners 160 may be removably connected (i.e., inserted) within at least one of the plurality of fastener receiving apertures 115.

Each of the plurality of fastener receiving connectors 170 may include a washer, a nut, a magnet, and/or any combination thereof, but is not limited there.

Each of the plurality of fastener receiving connectors 170 may removably connect to at least one of the plurality of rod fasteners 160. During use, the plurality of rod fasteners 160 may removably connect through the plurality of fastener receiving apertures 115 to the plurality of fastener receiving connectors 170 to secure the top section 112 to the bottom section 111, such that the top section 112 may be prevented from moving off the bottom section 111. Accordingly, the top section 112 may be adjusted (i.e., toward or away from) with respect to the bottom section 111 to adjust a height of the main body 110 based on a length of a leg of the user.

Therefore, the wearable climbing device 100 may provide stability for the user while climbing due to having the first arm and the second arm of the main body 110. Additionally, the calf strap 120 and/or the ankle strap 140 connect around different portions of the leg of the user to support the user and remain steady.

The present general inventive concept may include a wearable climbing device 100, including a main body 110, including a bottom section 111 to receive a foot of a user thereon, a top section 112 removably connected to at least a portion of the bottom section 111, and a spike 113 disposed on at least a portion of the bottom section 111 to penetrate into at least one of a tree and a utility pole, a calf strap 120 removably connected to at least a portion of the main body 110 to be worn around a calf of the user, and an ankle strap 140 removably connected to at least a portion of the main body 110 to be worn around an ankle of the user.

The bottom section 111 may include a bottom first arm 111*a*, and a bottom second arm 111*b* disposed in parallel to the bottom first arm 111*a*.

The main body 110 may further include a stirrup 114 disposed between the bottom first arm 111*a* and the bottom second arm 111*b* to receive at least a portion of the foot of the user thereon.

The top section 112 may include a top first arm 112*a*, and a top second arm 112*b* disposed in parallel to the top first arm 112*a*.

The spike 113 may be bent in an angular direction away from the bottom section 111.

The main body 110 may be adjustable in height by moving the top section 112 toward or away from the bottom section 111.

The calf strap 120 may include a plurality of layers.

The wearable climbing device 100 may further include a plurality of bracing bands 130 disposed on at least a portion of the main body 110 to receive at least a portion of the calf strap 120 therein and prevent the calf strap 120 from lateral movement within each of the plurality of bracing bands 130.

The plurality of bracing bands 130 may be removably connected to at least a portion of the top section 112.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A wearable climbing device, comprising:

a main body, comprising:

a bottom section to receive a foot of a user thereon, the bottom section comprising:

a bottom first arm, and a bottom second arm disposed in parallel to the bottom first arm, a top section movably and removably connected to at least a portion of the bottom section, the top section comprising:

a top first arm disposed in line with and parallel to the bottom first arm such that the top first arm is movably and removably connected to the bottom first arm, and a top second arm disposed parallel to the top first arm, such that the top second arm is disposed in line with and parallel to the bottom second arm such that the top second arm is movably and removably connected to the bottom second arm to allow the main body to be adjustable in height by moving the top section toward or away from the bottom section, and a spike disposed on at least a portion of the bottom section to penetrate into at least one of a tree and a utility pole;

a calf strap removably connected to at least a portion of the main body to be worn around a calf of the user; and an ankle strap removably connected to at least a portion of the main body to be worn around an ankle of the user.

2. The wearable climbing device of claim 1, wherein the main body further comprises:

a stirrup disposed between the bottom first arm and the bottom second arm to receive at least a portion of the foot of the user thereon.

3. The wearable climbing device of claim 1, wherein the spike is bent in an angular direction away from the bottom section.

4. The wearable climbing device of claim 1, wherein the calf strap comprises a plurality of layers.

5. The wearable climbing device of claim 1, further comprising:

a plurality of bracing bands disposed on at least a portion of the main body to receive at least a portion of the calf strap therein and prevent the calf strap from lateral movement within each of the plurality of bracing bands.

6. The wearable climbing device of claim 5, wherein the plurality of bracing bands are removably connected to at least a portion of the top section.

* * * * *